US006478287B2

(12) United States Patent
DeSouza

(10) Patent No.: US 6,478,287 B2
(45) Date of Patent: Nov. 12, 2002

(54) PLASTIC FENCE PANEL

(75) Inventor: Joseph DeSouza, North Royalton, OH (US)

(73) Assignee: U.S. Fence, LLC, Middleburg Heights, OH (US)

( * ) Notice: Subject to any disclaimer, the term of this patent is extended or adjusted under 35 U.S.C. 154(b) by 29 days.

(21) Appl. No.: 09/867,077

(22) Filed: May 29, 2001

(65) Prior Publication Data

US 2002/0011594 A1 Jan. 31, 2002

Related U.S. Application Data

(60) Provisional application No. 60/208,815, filed on Jun. 2, 2000.

(51) Int. Cl.[7] ..... E04H 17/16
(52) U.S. Cl. ..... 256/19; 256/31; 256/66
(58) Field of Search ..... 256/19, 24, 31, 256/64, 66

(56) References Cited

U.S. PATENT DOCUMENTS 4,722,514 A * 2/1988 Pettit ..... 256/19
5,702,090 A * 12/1997 Edgman ..... 256/19
5,938,184 A 8/1999 DeSouza
5,988,599 A * 11/1999 Forbis ..... 256/24
6,299,142 B1 * 10/2001 Chaney et al. ..... 256/19
6,345,809 B1 * 2/2002 Bebendorf ..... 256/24

FOREIGN PATENT DOCUMENTS

GB 2247901 A * 3/1992 ..... E04H/17/16

* cited by examiner

*Primary Examiner*—James R. Brittain
(74) *Attorney, Agent, or Firm*—Pearne & Gordon LLP

(57) ABSTRACT

A fence panel is constructed from extruded hollow polyvinyl plastic boards. The boards are arranged with vertical end boards and filler boards between the end boards. Three horizontal rails each have a board on each side of the vertical boards with a horizontal filler board between the top rail boards to seal off the upper ends of the vertical boards. All of the boards are secured together with a plastic adhesive without the use of any mechanical fasteners.

8 Claims, 3 Drawing Sheets

PLASTIC FENCE PANEL

This application claims the priority of U.S. Provisional Patent Application No. 60/208,815, filed Jun. 2, 2000.

SUMMARY OF THE INVENTION

This invention relates generally to plastic fences and more particularly to a unitary preassembled fence panel formed from plastic boards secured together with a suitable adhesive.

BACKGROUND OF THE INVENTION

Fencing has long been made from wood and metal in various decorative forms. Such fencing has many purposes from restraining the passage of animals to preserving the privacy of property and increasingly is provided as privacy fencing to prevent people on one side of the fence from viewing anything on the other side. Such privacy fencing tends to be expensive since it requires a large amount of material to completely occlude the area of the fence and may also present a problem that the fence appears different on each side, so that the fencing necessarily has a finished or outer side and unfinished or inner side.

Recent development of materials have involved the use of certain plastics such as polyvinyl chloride as fence materials because they can be easily fabricated by extrusion and by suitable compounding and coating present a finished surface that does not require frequent maintenance and painting.

While first efforts to utilize vinyl plastic as a fencing material tended to utilize existing construction and configurations using, in effect, hollow extruded vinyl boards in the place of wooden boards. However, it soon became apparent that vinyl fencing could be utilized with different configuration and materials and in fact could be made quite strong utilizing wood and metal inserts as shown in the present inventor's prior U.S. Pat. No. 5,938,184.

However, this method of construction while producing a strong and durable completed fence, required a high degree of labor in assembling the fence as well as a relatively long time period to complete the construction. Furthermore, although the members could be pre-cut to speed assembly, they still required individual fitting of the parts and assembly in the correct order as well as the use of a multiplicity of fasteners often of different sizes and appearances.

SUMMARY OF THE INVENTION

The preferred embodiment of the present invention provides an improved construction in which all of the fence components between the posts are preassembled as a unitary panel at the factory to allow rapid mounting and assembly on the appropriate fence posts.

Another feature of the invention is that the fence appears the same from both sides so that it can be mounted either side out or in and will have the same appearance.

Another feature of the invention is that it does not require any fasteners which mar the external appearance or give a different appearance from opposite sides.

Another feature of the invention is that it can be preassembled at the factory utilizing a minimum of different extrusions and is preassembled using a suitable glue or cement to secure the individual board members together without other fasteners.

Still another feature of the invention is that the resulting panel is extremely strong and rigid and can be made in a number of different constructions to give different types of decorative appearance for greater variety and can be manufactured in different sizes of panel heights and widths as desired for the finished fence.

DETAILED DESCRIPTION OF THE INVENTION

Figure 1:
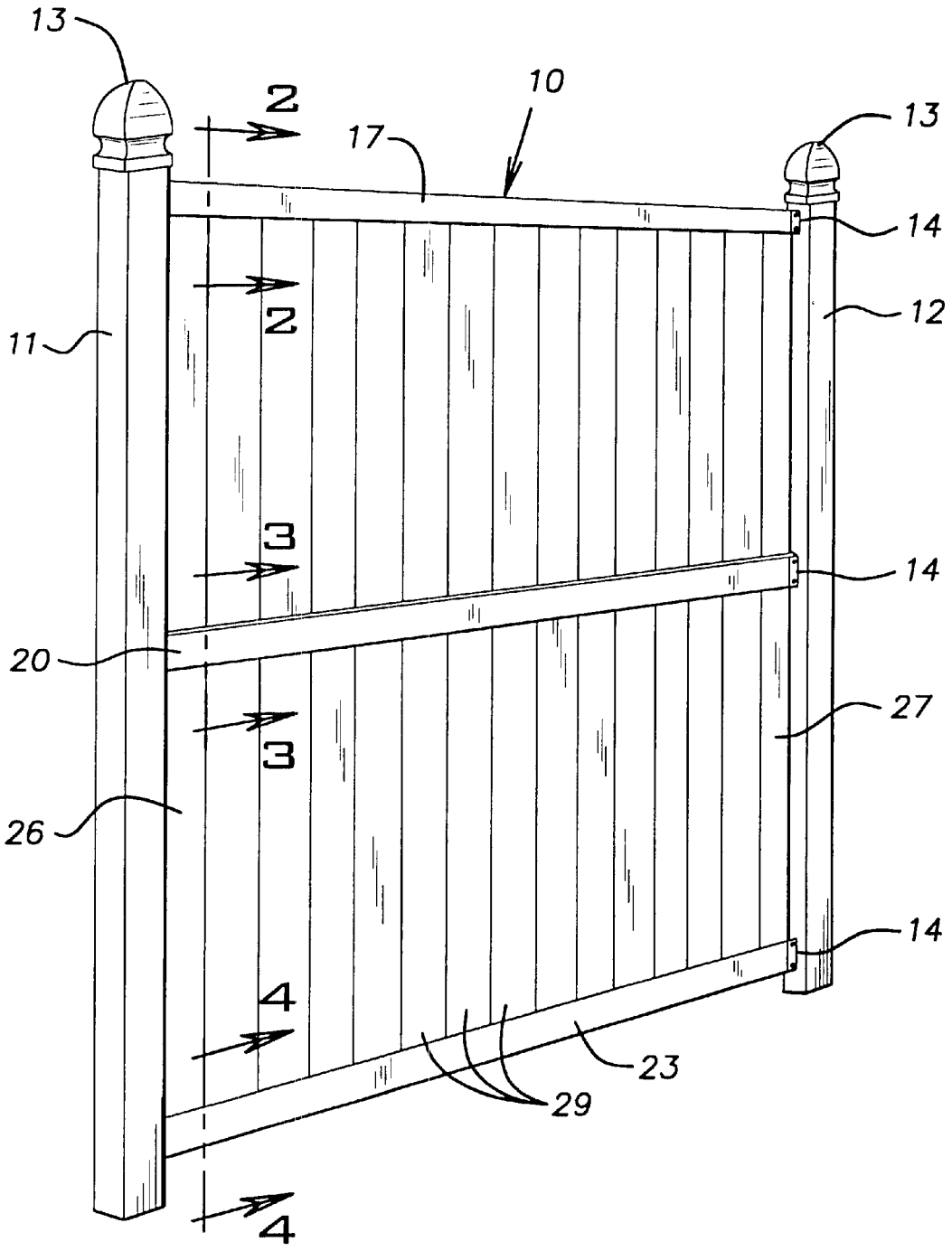
FIG. 1 is a perspective view of a fence panel according to the preferred embodiment of the invention shown mounted between a pair of fence posts.

Referring now to the drawings in greater detail, FIG. 1 shows a fence section according to the preferred embodiment of the invention mounted in place between two posts. The panel 10 as will be described in greater detail hereinafter, is a unitary assembly as shipped from the factory and ready for mounting on the posts. The posts 11 and 12 are preferably of a hollow polyvinyl chloride extrusion, as are the components of the panel 10 and these components can be extruded as a finished part with a base material for strength as well as a finished layer on the surface which is the final finish of the part and particularly compounded to be weather resistant including a high degree of resistance to sunlight and ultraviolet radiation. The exact formulation of the vinyls and their method of extrusion are well known in the art and therefore will not be described in any greater detail herein.

The posts 11 and 12 may either be set directly in the ground or in concrete or if greater strength is required they may be fitted as covers over a wood or metal core extending into the ground. Alternatively, the posts after setting in place may be filled with concrete. In any case, the posts 11 and 12 are covered by a decorative cap 13 intended to prevent any water from draining into the interior of the post and these cap 13 are usually glued in place with a suitable vinyl cement. As shown in FIG. 1, a plurality of brackets 14 are mounted on the inside opposing faces of the posts 11 and 12 to support the panel 10. Brackets 14 may be identical with those disclosed in the present inventor's U.S. Pat. No. 5,938,184 granted Aug. 17, 1999 in which is incorporated herein by reference.

The panel 10 is a unitary piece as shipped from the factory and is ready for mounting on the brackets 14 after they have all been secured to the posts 11 and 12. Panel 10 includes three rail assemblies, namely, the top rail assembly 17, the middle rail assembly 20 and the bottom rail assembly 23 as shown in cross-section in FIGS. 2–4. While the rail assembly 17, 20 and 23 provide the horizontal connections and also tie together the posts 11 and 12 by their connections to the brackets 14, the vertical positioning is provided primarily by the end boards 26 and 27 which extend vertically from the bottom rail assembly to the top rail assembly, through the slots in the brackets 14 and are therefore so positioned that they are located slightly inwardly from the ends of the rails and therefore spaced slightly from the surfaces of the posts 11 and 12. The space between the two end boards 26 and 27 are, in the embodiment shown in FIG. 1, spaced apart by filler boards 29 which also extend the full distance between the top and bottom rail assemblies, although in other arrangements such as the embodiment shown in FIG. 6 the filler boards extend only between the bottom and the middle rail assembly.

The top rail assembly 17 comprises a pair of top rails 31 and 32 which is secured to each side of a filler rail 33 and the adjacent ends of the end boards 26 and 27 and filler boards 29. All of these pieces are cemented together with a suitable vinyl cement and are aligned so that they define an even top edge 34 along the top of the panel 10.

Figure 3:
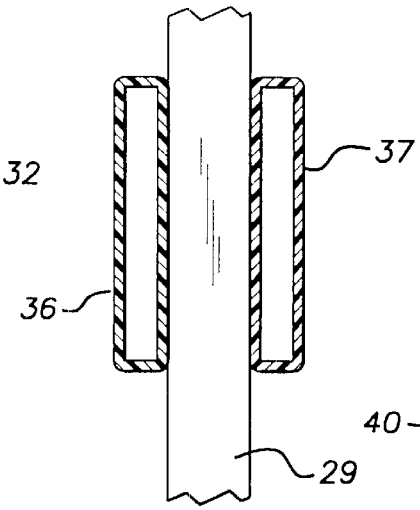
FIG. 3 is a cross-section taken through the middle rail as shown on line 3—3 of FIG. 1.
Figure 4:
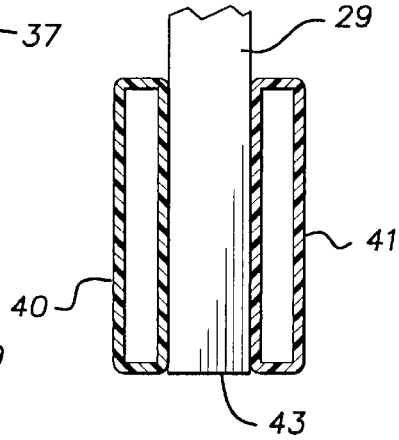
FIG. 4 is a cross-sectional view taken on line 4—4 of FIG. 1 showing the bottom rail.

In a similar manner, the middle rail assembly comprises middle rails 36 and 37 which are glued to either side of the adjacent vertical boards as shown in FIG. 3. As shown in FIG. 4, the bottom rail assembly 23 comprises a pair of bottom rails 40 and 41 which are secured to the bottom portions of the vertical boards with the bottom edges of the rails in alignment with the bottom end of the boards to define a bottom edge 43.

Figure 2:
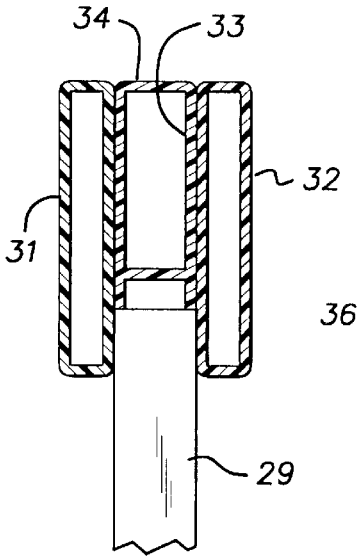
FIG. 2 is a cross-section through the top rail taken on line 2—2 of FIG. 1.

The embodiment of FIGS. 1–5 has the advantage that the entire panel is formed from only two different types of extruded boards. These boards will have similar exterior finishes since in the extrusion process the basic structural polyvinyl chloride material is coated with a finished surface coating in a desired color such as white that incorporates various materials as well known in the art to prevent damage from sunlight and weathering so that basically the boards never require any refinishing after the fence panel has been assembled. As shown in FIGS. 2, 3 and 4, the rail numbers are in the form of a simple rectangle and in one structure will have the dimensions of ⅔"×½" with a 1/16 wall. The boards are somewhat larger having a width of 4¼" and a thickness of ¾" and have a pair of partition walls (see FIG. 5) in the interior to prevent collapse. These partition walls 46 are extruded with the rest of the board and extend transversely between the side walls 47. This arrangement allows the filler rail 33 at the top to be formed by cutting a board lengthwise into two halves between the partition walls 46 and this allows the halfboard to form the filler rail 33 shown in FIG. 2 and since this rail is therefore narrower than the main inner and outer rails the latter will extend farther down to abut the sides of the ends of the vertical boards to which they are glued in like manner.

Figure 5:
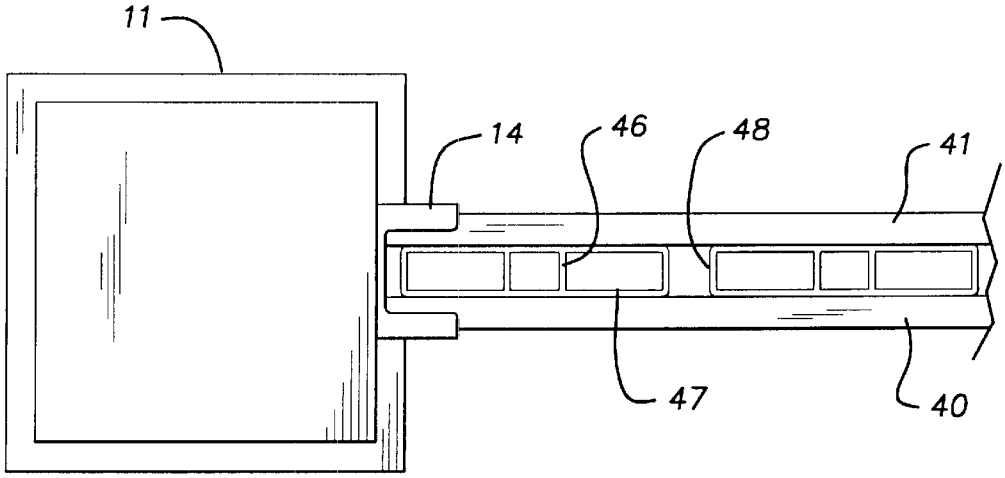
FIG. 5 is a fragmentary horizontal sectional view of the top rail and post with the filler rail removed.

With this arrangement, assembly of the unit is simple by using a suitable framework for holding the end boards 26 and 27 together with filler boards 29. The vinyl adhesive or glue is then put to the rails which are pressed together and held in place until the glue is hardened, after which the completed rail is ready for use. Since the vertical boards are hollow, the filler rail 33 at the top seals off the interior to prevent entry while the boards are open at the bottom rail assembly 23 as shown in FIG. 5. Also as shown in FIG. 5, other spacing could be made to allow a space 48 to be used between adjacent boards to allow passage of air unless complete privacy is desired where the vertical boards abut each other on the sides.

Figure 6:
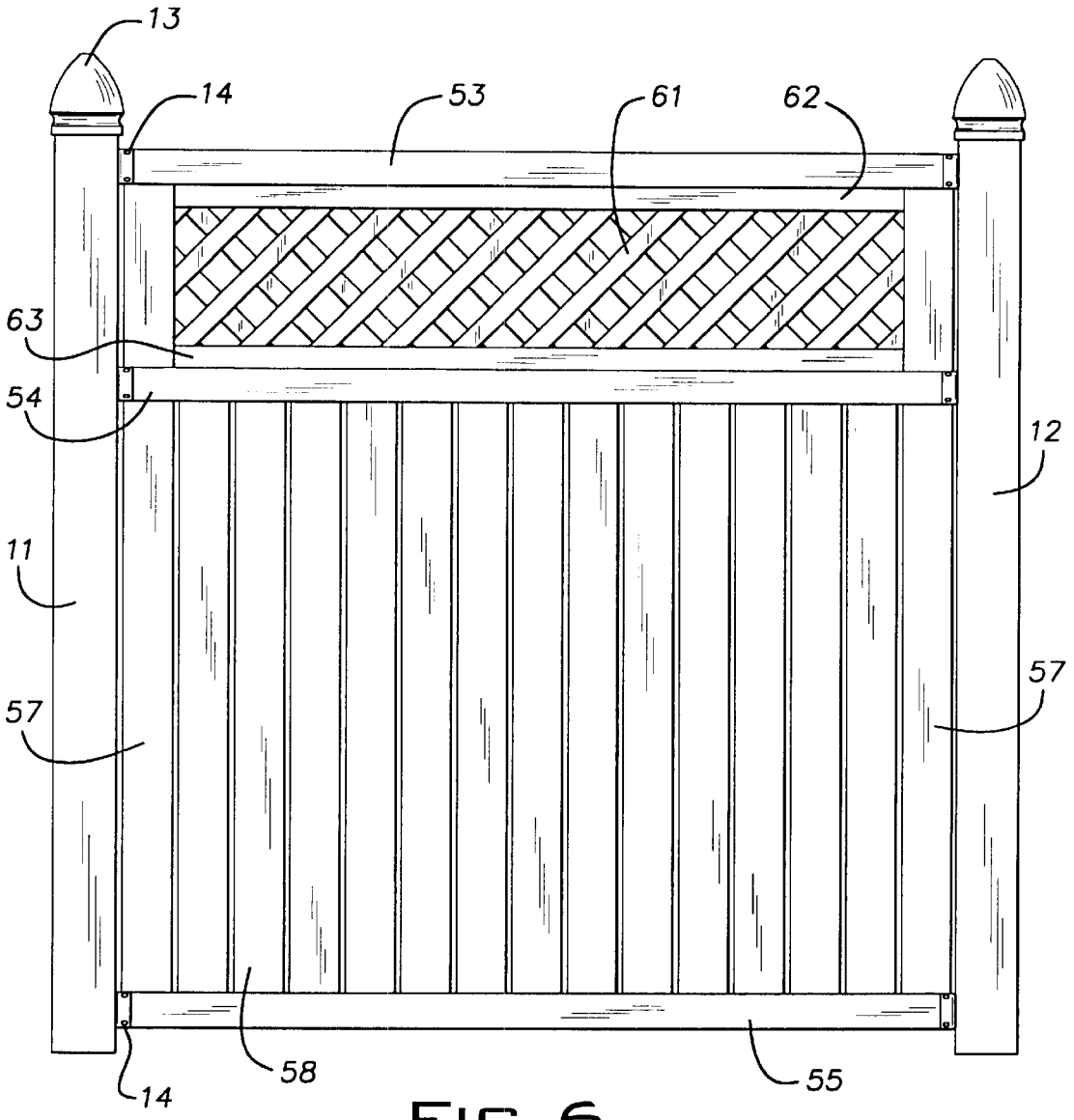
FIG. 6 is a front elevational view of another embodiment of the fence panel.

This construction lends itself to other arrangements such as the embodiment shown in FIG. 6. For a different design panel 51 is mounted between the same posts 11 and 12 by the same type of bracket 14. The panel 51 comprises top, middle and bottom rails 52, 54 and 55 together with vertically extending end boards 57 and shorter filler boards 58. In this arrangement, the end boards 57 extend the full distance between the top rail 53 and the bottom rail 55 while the filler boards 58 extend only between the middle rail 54 and the bottom rail 55. This leaves a space which can be filled decoratively by a lattice panel 61 which fits within top and bottom holder rails 62 and 63 which extend into the space between the top and middle rails 53 and 54 and are glued to the rails to form a complete unitary assembly for the panel. The assembly of the fence structure is done by putting the posts 11 and 12 in place in the ground in the well known manner. The brackets 14 are then secured to the opposed side faces of the post by suitable means such as screws or other fasteners and the completed panel 10 can be inserted in place. To accomplish this, the panel is placed with the rail slightly above the brackets in alignment and inserted into the channels of the brackets at one of the posts. The panel can then be flexed, since the vinyl is not completely rigid, and the other rails align so that the adjacent end board fits within the brackets. The panel is then lowered in place until the rails rest on the brackets and suitable fasteners such as screws can be inserted through the sides of the bracket to hold the panel to the posts. The result is a finished fence panel that is substantially maintenance free and does not require painting or other surface treatment for the life of the fence.

What is claimed is:

1. A plastic fence structure comprising plastic horizontal top, middle, and bottom rails and vertical end boards extending between said top and bottom rails adjacent the ends thereof, said structure including vertical filler boards extending at least between said middle and said bottom rails, each of said vertical boards being a plastic extrusion of hollow rectangular shape having side walls and edge walls forming the rectangle, said top, middle, and bottom rails each comprising a pair of opposed hollow rectangular rail boards abutting the vertical boards on each side and secured thereto by an adhesive, said top rail boards extending above the top ends of said vertical boards, said top rail including a filler board positioned between said top rail boards and secured thereto above the top ends of said vertical boards to seal off the interior of said vertical boards.

2. A plastic fence structure as set forth in claim 1, wherein said vertical filler boards extend between said top and bottom rails.

3. A plastic fence structure as set forth in claim 1 including a panel extending between said middle and top rails and between said vertical end boards.

4. A plastic fence structure as set forth in claim 3, wherein said panel includes upper and lower holder rails extending between the respective top and middle rails.

5. A plastic fence structure comprising plastic horizontal top, middle, and bottom rails and vertical end boards extending between said top and bottom rails adjacent the ends thereof, said structure including vertical filler boards extending at least between said middle and said bottom rails, each of said vertical boards being a plastic extrusion of hollow rectangular shape having side walls and edge walls forming the rectangle, each vertical board having two internal walls extending parallel between said side walls a spaced distance apart equidistant from said edge walls, said top, middle and bottom rails each comprising a pair of hollow rectangular rail boards abutting the vertical boards and secured thereto by an adhesive, said top rail boards extending above the top ends of said vertical boards, said top rail including a filler board positioned between said top rail boards and secured thereto to seal off the interior of said vertical boards.

6. A plastic fence structure as set forth in claim 5, wherein said vertical filler boards extend between said top and bottom rails.

7. A plastic fence structure as set forth in claim 5 including a panel member extending between said middle and top rails and between said end boards.

8. A plastic fence structure as set forth in claim 7, wherein said panel is secured to said top and middle rails.

* * * * *